United States Patent [19]

Romanin

[11] 4,341,375

[45] Jul. 27, 1982

[54] DUAL VISE FOR SKIS AND THE LIKE

[76] Inventor: Mario Romanin, 3230 Somia Dr., Parma, Ohio 44134

[21] Appl. No.: 260,419

[22] Filed: May 4, 1981

[51] Int. Cl.[3] ..... B25B 1/20

[52] U.S. Cl. ..... 269/43; 269/95; 269/153; 269/181; 269/184; 269/253; 269/906

[58] Field of Search ..... 269/906, 43, 181–187, 269/173–175, 152, 153, 95, 97, 253; 411/437, 433

[56] References Cited

U.S. PATENT DOCUMENTS

| | | | |
|---|---|---|---|
| 80,997 | 8/1868 | Pearson | 269/187 |
| 446,078 | 2/1891 | Rouse | 269/186 |
| 3,861,664 | 1/1975 | Durkee | 269/906 |
| 4,066,250 | 1/1978 | Campbell | 269/906 |
| 4,081,180 | 3/1978 | Munn | 269/906 |
| 4,241,906 | 12/1980 | Cole | 269/43 |

*Primary Examiner*—Robert C. Watson
*Attorney, Agent, or Firm*—Alfred D. Lobo

[57] ABSTRACT

A deliberately simple ski vise is provided which utilizes essential structural elements requiring only a minimum of machining. The vise is preferably used in conjunction with another identical vise to hold skis securely to a table top or other flat surface while the skis are 'tuned' or otherwise worked upon. The skis may be clamped in any desired position, and irrespective of the widths of the skis, the skis may be clamped in position and unclamped with unprecedented ease and speed. A novel, quick-release mechanism is provided on the vise which serves to lock movable jaws of the ski vise relative to each other so as to negate longitudinal travel relative to each other except by rotation of a rod which is at least partially threaded to provide a screw-clamping action.

6 Claims, 5 Drawing Figures

DUAL VISE FOR SKIS AND THE LIKE

BACKGROUND OF THE INVENTION

This invention relates to workholders having relatively movable jaws and plural jaw pairs which are commonly actuated. In a particular application, such a workholder may be used to drill or otherwise machine plural articles clamped in side-by-side relationship. The invention more particularly relates to the use of plural workholders which are used as a pair to hold no more than two workpieces or articles parallel to each other. In a particular application, a pair of dual vises of this invention is used to clamp a pair of skis side-by-side, so that they may be worked on, and it is in this particular context that this invention will be described.

Sporting goods stores offering professional services in the field of mounting bindings on skis, repairing damaged skis, and "tuning up" skis are expected to have suitable ski-clamping means mounted on a 'ski bench', and usually do. Such a clamping means secures a pair of skis in side-by-side relationship so the skis can be worked on simultaneously. By "tuning up" skis I refer to sharpening the steel edges and "flat-filing" the bottoms of skis as explained hereinbelow. One who tunes up skis is referred to herein as a "tuner" of skis.

Steel edges are provided on skis to allow them to be edged effectively in all conditions of snow, whether packed or "powder", even when it is interspersed with ice. Such sharpening is usually done manually with a mill file, while the skis are held horizontally and on-edge, that is, with one steel edge vertically above the other, also referred to as the "edge-up" position.

The bottom or "running surface" of a ski must also be worked on to ensure that it is flat and free from nicks or gouges inflicted by contact with hard objects obscured by the snow and run over by the skier. Therefore the bottom surface is filled with synthetic resinous material such as polyethylene or other filler material, and the surface is "tuned" by shaving or filing the bottom until it is flat. This tuning of the bottom surface, referred to as "flat-filing", also dresses the bottom surfaces of the steel edges. Flat-filing is most conveniently effected by clamping the skis in a horizontal "bottom-up" or inverted position. Thereafter, the running surface is waxed.

Ski bindings are mounted on the upper surfaces of skis usually by drilling appropriate holes in the skis. Further, many skis are conventionally engraved or otherwise marked with identification of their ownership. For both these operations the skis are clamped in a horizontal "top-up" or normal position.

In whichever of the foregoing positions the skis are clamped, they must be held securely, and adequately supported to withstand the pressure exerted by a tuner working upon them.

To accomplish such clamping effectively, a ski shop typically has a large clamping device mounted on a ski table or bench. Such a device is generally as costly as it is cumbersome to use. Apart from the cost, such devices usually require the tuner to balance both skis in the clamping jaws of the device, the jaws being near each end of the skis, then use both his hands on each of the clamping means to securely clamp the skis in place. This is usually neither easy nor quick because the skis are easily displaced before they are clamped. When the skis are to be released, the tuner is usually forced to turn the locking screw of the typical device many times before the skis may be freed from the clamping means. When there are many skis to be worked upon, the time factor acquires overriding importance. It is essential that a desirable clamping means be provided with a quick-clamping mechanism which is essentially insensitive to changes in widths of the skis, and that the clamping means also be provided with a quick-release mechanism.

The essentials of an effective ski vise are more sharply focussed if it is to be priced within the reach of the burgeoning population of ski enthusiasts who routinely tune up their own skis. In addition to being inexpensive, the ideal ski vise should be portable, since many operations such as waxing skis, whether hot-waxing them or not, are often most efficiently accomplished at the slopes consonant with the skiing conditions, and it is most desirable to have a portable ski vise in which the skis to be waxed may be clamped. Waxing is an especially important requirement in cross-country skiing. Even if one did not wish to carry the vises around, it is most convenient to be able to store the vises when not in use, rather than have an entire bench devoted to mounting them even when they are not required. The dual vise of this invention is easily transported and may be adapted for use either on the hood of a car, or on a standard table.

The foregoing aspects of the requirements of a ski vise are partially referred to in U.S. Pat. Nos. 3,921,967 and 4,066,250 to Campbell and 4,241,906 to Cole, inter alia. Referring first to Campbell's 4,066,250 patent, he describes a vise in which the clamping pressure on the 'aft' ski (further away from the clamping screw), is transmitted through the intermediate movable jaw which is common to both the 'fore' and 'aft' skis, thus helping balance the pressure. The quick-release mechanism relies on a bracket which gets cammed between the clamping screw and a cylindrical mounting rod. Referring to Cole, there is disclosed a dual vise, again, with an intermediate movable jaw common to both skis which are locked in position with a cam and spring mechanism to obviate using a clamping screw.

U.S. Pat. No. 2,662,433 uses a screw mechanism to clamp plural workpieces which, as in the aforementioned patents, are also piled up, but at least two of the plural intermediate movable jaws are linked, and the screw mechanism requires a threaded rod with both right and left hand threads, the rod being threadedly engaged in a hollow internally threaded tube. Moreover, there is no pressure equalization even if the articles clamped are the same size, and no quick release if the articles are of different sizes.

The prior art structures fail to disclose the functional attributes and co-action of the elements of the improved vise of my invention. Most important, the dual jaw vise of this invention is the essence of simplicity, utilizing so few structural elements that it is inexpensive, yet so efficient in its action that it may be used to quickly lock and release skis with unprecedented ease and speed.

SUMMARY OF THE INVENTION

A multiple jawed vise has been designed and constructed which utilizes essential structural elements for its deliberately simple construction, requires a minimum of machining operations for its production, and yet provides an ease and convenience of use which is as desirable as it is unexpected.

It is a specific object of this invention to provide a vise for clamping no more than two articles such as skis in a side by side relationship, so that they may be worked on together, rather than one at a time; and, to allow a person to hold each of the articles, and position it in the jaws of the vise with one hand, and then to clamp both articles in the jaws with the other hand.

It is a more specific object of this invention to provide a vise for skis which may be clamped either vertically (on edge), or horizontally (widthwise), or even one ski on edge and the other width-wise, in such a manner that neither ski is displaced during clamping.

It is another specific object of this invention to provide a vise which clamps articles in side by side relationship without "piling up" the articles in the jaws, and without requiring manually touching the jaws to do so.

It is yet another object of this invention to provide a four-jawed vise with the end jaws fixedly disposed, and the intermediate jaws movable relative to each other, so that each article is separately clamped in a pair of jaws, and no jaw is a common clamping member for both articles.

It is a further object of this invention to provide a unique locking mechanism which permits the articles to be positioned in the jaws by free travel of the movable jaws relative to each other; which then locks the movable jaws relative to one another so as to negate the free travel except by rotation of a single threaded rod; and finally, permits quick-release of the articles so that they can be immediately lifted out of the jaws.

BRIEF DESCRIPTION OF THE DRAWINGS

The foregoing and other objects and advantages of my invention will appear more fully from the following description, made in connection with the accompanying drawings of preferred embodiments of the invention, wherein like reference characters refer to the same or similar parts throughout the several views and in which.

DETAILED DESCRIPTION OF PREFERRED EMBODIMENTS

In the preferred embodiment, a pair of dual vises will be used to clamp skis to be worked upon, each dual vise being of identical construction. Thus, when a pair of skis are clamped in the vises in side-by-side relationship, the skis are horizontal and lie in essentially the same plane. The term "dual vise" (hereafter simply "vise" for brevity) is used to describe a single member of the pair which will usually be used, because each member incorporates two vises and has no common vise jaw for the support of both skis. It will soon be evident that it is not essential that two skis be clamped in place, and that a single ski may be clamped and worked on, if desired. Similarly, for obvious reasons, it is desirable to use two vises, but it is not essential, and one vise may suffice where, for example, only the 'tail' of a ski is to be worked on, and the head of the ski can be adequately supported, or vice versa; or, where the mid-section of the skis are to be worked on, and the ends of the skis can be adequately supported.

Figure 1:
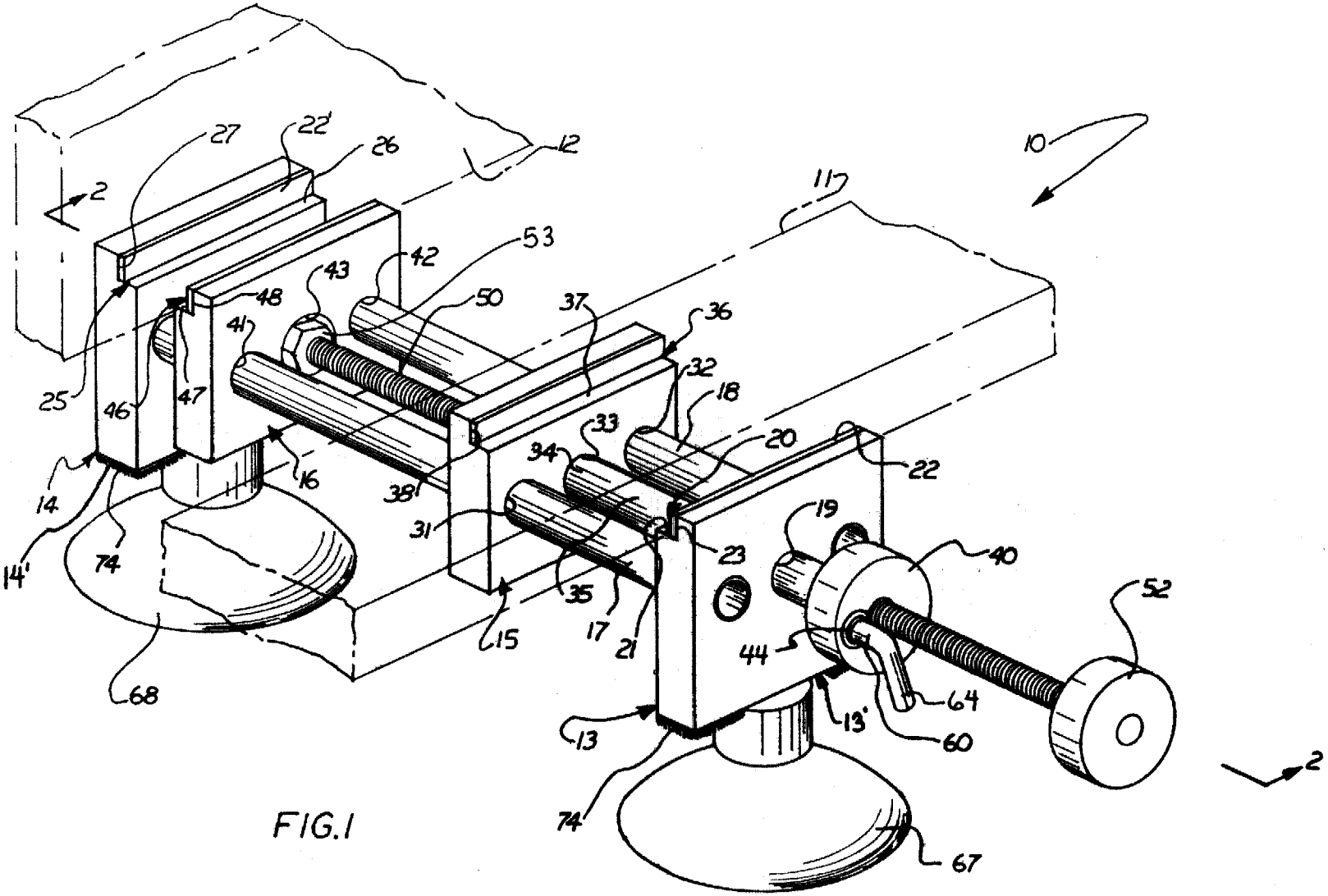
FIG. 1 is a perspective view of a vise clamping skis, shown in phantom outline, one (the 'fore' ski) in the "bottom up" position, and the other (the 'aft' ski) in the "edge-up" position.
Figure 2:
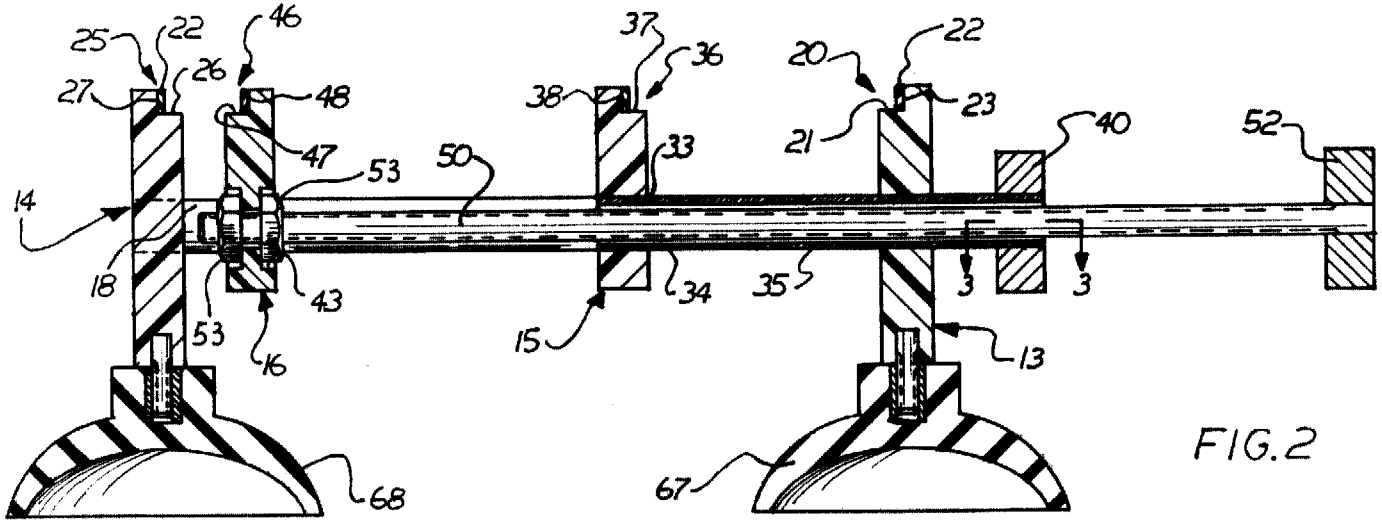
FIG. 2 is an elevation view in cross-section along the line 2—2.
Figure 3:
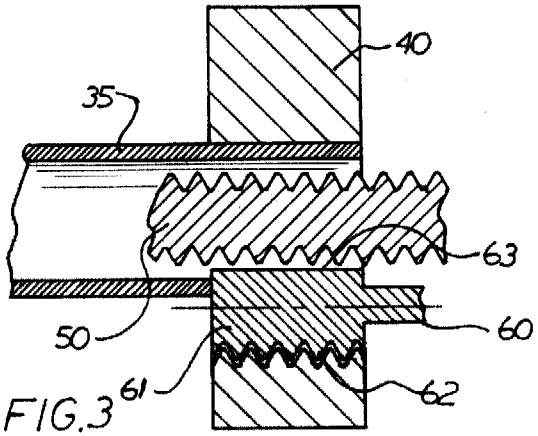
FIG. 3 is a detail plan view in cross-section along the line 3—3, of the quick-release thread-locking mechanism showing threads of a locking member of the mechanism disengaged so as to allow free travel of the movable jaws relative to one another.
Figure 4:
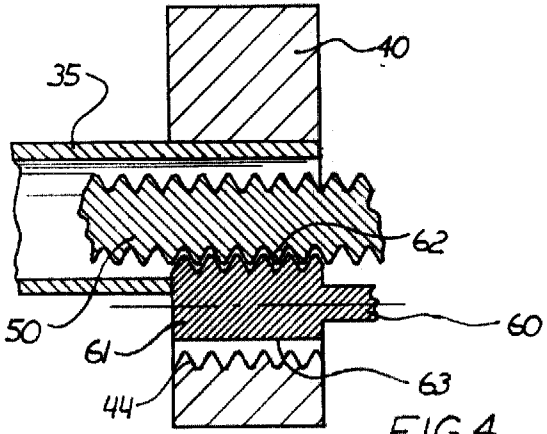
FIG. 4 is a detail plan view in cross-section along the line 3—3 showing the quick-release thread-locking mechanism with threads of the locking member threadedly engaged.

Referring first to FIG. 1, there is shown a perspective view of a vise, indicated generally by reference numeral 10, clamping a pair of skis 11 and 12 shown in phantom outline, one ski 11 (the 'fore' ski) in the "bottom up" position, and the other ski 12 (the 'aft' ski) in the "edge-up" position. Normally, both skis will be clamped in the same position, either the edge-up, bottom up, or normal positions; these different positions are recited with reference to the drawing mainly to show that both skis need not be in the same position when they are clamped.

Each of the vises 10 are relatively small so they may be easily packed in a travel bag, or inserted into a ski bag of the type in which skis are carried. For this particular application, that is, as a ski vise, the construction of the vise is of light but strong materials, but for industrial applications, for example for the drilling of heavy castings, the vise may be much larger and formed from forged steel components.

Each vise comprises a pair of upstanding first and second end jaws 13 (first or 'fore' jaw) and 14 (second or 'aft' jaw), which are fixedly disposed relative to each other, and a pair of movable jaws 15 (first or 'fore' movable jaw) and 16 (second or 'aft' movable jaw) which are slidably disposed on a pair of transversely spaced-apart guide rails 17 and 18. The ends of the guide rails are press-fitted or otherwise fixedly positioned in recesses provided in the end jaws 13 and 14, and though the cross-section of the guide rails is not critical, it is most practical to use cylindrical tubing of any relatively strong and light material, 0.5" (inch) diameter aluminum tubing being preferred. The guide rails are each inserted in the end jaws 13 and 14 at a sufficient height above their bases 13' and 14' respectively to provide room to clamp the skis securely in an edge-up position. Typically, each end jaw is about 2.5" wide and about 2.75" high, and the guide rails are positioned parallel to each other in a horizontal plane, about mid-way. A bore 19 is also provided in end jaw 13, intermediate the guide rails.

First end jaw 13 (the 'fore' end jaw) is provided at the top with a step 20 having a horizontal planar surface 21 upon which one side of ski 11 rests. A strip of resilient material 22 is secured, preferably adhesively, to the vertical wall 23 of the step 20. As can be seen, step 20 cradles one longitudinal (fore) edge of first ski 11, the other (aft) edge being supported by movable jaw 15 as will be explained hereinafter. Similarly, the 'aft' or second end jaw 14 is provided with a step 25 having a horizontal platform 26 and a resilient strip 22' secured to the vertical wall 27 of the step 25, except that step 25 is notched facing step 20.

First movable (fore) jaw 15 is provided with bores 31 and 32 through which guide rails 17 and 18 are respectively inserted, and first movable jaw 15 is slidably disposed on the guide rails. The movable fore jaw 15 is also provided with a bore 33 in which one end 34 of an elongated hollow member 35 is press-fitted. The hollow member 35 is preferably a cylindrical tube (hereafter "tube") with a smooth bore, and for convenience is of the same size (about 0.5" nominal diameter) as that used for the guide rails 17 and 18. Tube 35 is slidably inserted in bore 19 and protrudes therefrom for a short distance, terminating in a spacing member 40.

Movable fore jaw 15 is provided at the top with a step 36 having a horizontal planar surface or platform 37 upon which one edge of a ski may rest. A strip of resilient material 22 is secured to the vertical wall 38 of the step 36 in a manner similar to steps 20 and 25. Step 36 faces step 20 of fore end wall 13 and one step is substantially a mirror image of the other for ease of manufacture.

Second movable (aft) jaw 16, like movable fore jaw 15, is provided with bores 41 and 42 through which the guide rails 17 and 18 are respectively inserted, and the jaw 16 is slidably movable on the guide rails. Intermediate the bores 41 and 42 there is also provided another bore 43 in which one end of a rod member 50 is journalled for rotation about its longitudinal axis. When rod 50 is threaded stock, lock nuts 53, one on either side of movable jaw 16 may be used to rotatably secure the end of the threaded rod 50 in the movable jaw 16.

Movable aft jaw 16 is provided at the top with a step 46 having a horizontal planar surface or platform 47 upon which one edge of a ski may rest. A strip of resilient material 22 is secured to the vertical wall 48 of the step 46 in a manner analogous to that described hereinbefore. Step 46 faces step 25 on aft end jaw 13 and is substantially a mirror image thereof, also, as in the pair of fore jaws of the vise, for ease of manufacture.

Rod 50 is inserted within tube 35 and extends therethrough beyond the spacer member 40, the rod terminating in a knob 52. The rod 50 is at least partly threaded, that is, it is threaded over at least that portion of its length which is in the immediate vicinity of the spacer member when the movable jaws are positioned to clamp the skis in any preselected position. As a matter of convenience, it is more practical to use threaded stock for the rod 50, and it is substantially coaxially disposed within tube 35. Knob 52 may be replaced with a T-handle or any other handle means such as is conventionally used to manually rotate a screw such as the rod 50, but a small knob about 1.375" in diameter is preferred because it provides sufficient pressure on the skis without an undue risk of exerting excess pressure so as to damage either the skis or the vise.

Spacer member 40 is provided with a threaded bore 44 in which a locking member indicated generally by reference numeral 60, is threadedly disposed in parallel spaced apart relationship with the rod 50. The space member 40 is shown as a hub, mostly because of its desirable design, though it will be evident that a broken away flange portion, or a projecting stub wide enough to threadedly accept the longitudinally partially threaded arm 61 of the locking member 60 will be equally satisfactory.

The locking member 60 is preferably L-shaped, one arm 61 of the 'L' in threaded bore 44 being threaded longitudinally along its one side 62 of its length for more than 180° of its perimeter, so that it will be held in the bore; the other side 63 being flattened over a minor portion of the circumference so as to afford clearance for the threads of the threaded rod 50. The other arm 64 of the 'L' serves both as a handle to rotate the locking member and to indicate whether or not the threads on side 62 are engaged with threads on the threaded rod 50.

As illustrated, arm 61 lies in substantially the same horizontal plane as the longitudinal axis of the rod 50. In the "up" position, arm 64 lies at about 60° to the horizontal, tangentially against the upper portion of the threads of rod 50, and indicates that the threads of the rod and the locking member are disengaged. In the "down" position, the arm 64 lies at about a 60° angle to the horizontal, tangentially against the lower portion of the threads of the rod 50, and indicates that the threads of the rod and the locking member are locked into engagement. Clearly, the angle at which the arm 64 lies against the threads of rod 50 will depend upon the relative sizes of the rod and arm 64, but it illustrates simply that the arm 64 may be rotated until it abuts the upper and lower portions of threads of rod, on either side thereof, respectively, to indicate whether the rod member is freely longitudinally translatable, or not.

The rod 50 is unidirectionally threaded, that is, it is threaded for either right hand or left hand threads, the former being conventional and preferred. When the threads of the locking member 60 and the rod 50 are engaged, the position of the movable jaws relative to each other is fixed, except if the rod 50 is rotated. If the rod 50 is rotated clockwise, aft movable jaw 16 is propelled towards the end jaw 14, and the fore movable jaw 15 is advanced simultaneously towards the fore end jaw 13, assuming a right hand thread on rod 50. Since the relative motion of the movable jaws away from each other is effected by rotation of the threaded rod 50, the rate at which such relative movement of the movable jaws occurs is determined by the pitch of the screw threads, and of course the rate at which the rod 50 is rotated.

When the threads of the locking member 60 are disengaged from the threads of the rod 50, the movable jaws are movable independently, there being nothing more than an insignificant amount of friction between the threads of the rod 50 and the smooth inner surface of the bore of the hollow member 35.

All the jaws, whether fixed or movable, are preferably made from rigid synthetic resinous material such as slabs of nylon, polypropylene or high density polyethylene, for reasons of economy of machining them, and because such materials are much lighter than steel. Because each vise is relatively light when constructed with such materials, and particularly if the jaws are mounted on aluminum guide rails, the vises are preferably secured to a bench or other flat surface when they are to be used to tune up skis. To do this conveniently, the end jaws 13 and 14 are provided with rubber suction cups 67 and 68 which are threadedly secured to the bases 13' and 14' respectively of the end jaws. When the cups are pressed on to a flat, smooth surface, they firmly secure the vise to the surface.

Figure 5:
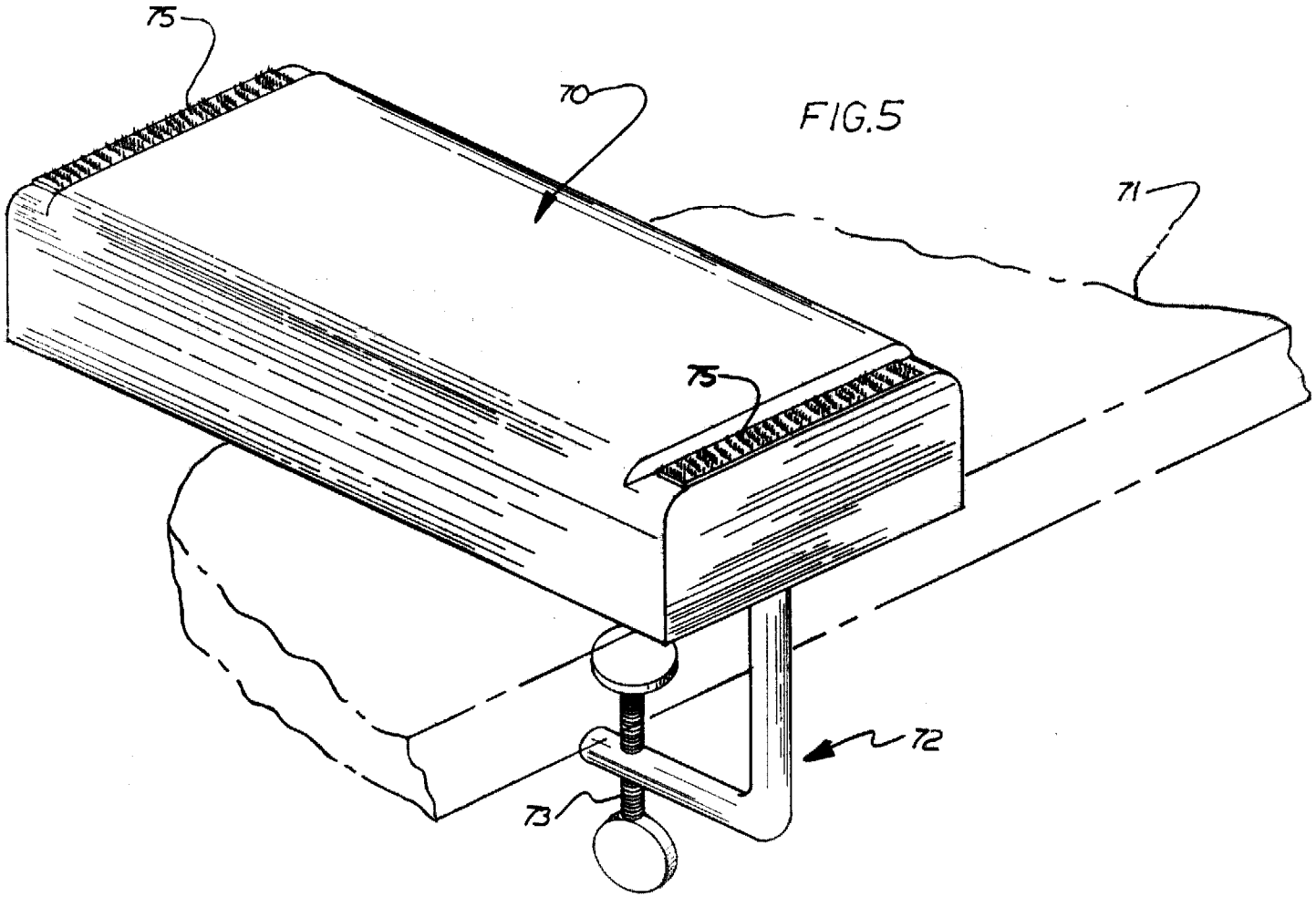
FIG. 5 is a detailed view, in perspective, with portions broken away, of a mounting block to which end jaws of each vise maybe demountably secured.

Alternatively, as illustrated in detail perspective view shown in FIG. 5, each of the vises (shown with portions broken away) may be mounted on a mounting block 70 which in turn is clamped or otherwise secured to the surface of a bench or table top 71. Such a block is provided with a clamp 72 having a clamping screw 73 which is tightly abutted against the lower surface of the table top to which the block is secured. The upper surface of the block 70 is provided with a pair of strips with interlocking hooks made of synthetic resinous material such as Dual-Loc strips 75, one near each end of the block, corresponding to the resting positions of the bases 13' and 14' of the end jaws each of which is also provided with Dual-Loc strips 74 which lock into the Dual-Loc strips 75 on the mounting block when downward pressure is exerted on the jaws. The vises are removed from the mounting blocks simply by pulling upwards to release the grip of the interlocked Dual-Loc strips. Other locking strip materials such as Velcro strips, made with interlocking hook and eye means formed of synthetic resinous material such as nylon, polypropylene or the like, or any other interlocking means which are releasably interlocked may be used. Any other method of securing the vises to a firm support may also be used, depending upon the particular conditions of use.

The rotatable locking member 60 is a particularly convenient, novel and unobvious way of providing the necessary locking action on the threads of the threaded rod 50. It is not essential that this locking action be provided with a rotatable locking member, and there are other ways of doing this which are known in the art. For example, a spring-loaded blade having one U-shaped end to engage the threaded rod may be used. Such a blade is radially spring-biased towards the longitudinal axis of the rod 50, and may be mounted either on the hub, or on the front face of end jaw 13. If mounted on the front face of jaw 13, it may be mounted pointing vertically downward and directly above hollow tube 35 the top portion of which would be cut away so as to provide the blade access to the threads of rod 50, which threads the blade would have to engage to provide the necessary locking action.

Though still other known means of locking the threaded rod 50 to the hollow tube member 35 may be provided, it will be immediately evident to one skilled in the art, that the rotatable locking member 60 disclosed herein is uniquely well-adapted for the easy and quick action which is so desirable when working on skis. Whatever other mechanism may be provided, the effect is to lock the hollow tube 35 relative to the threaded rod 50 so that the movable jaws 15 and 16 may be translated either towards or away from each other, by simply rotating the threaded rod 50.

In a typical actual operation, two vises are mounted along the front edge of a bench, spaced apart so as to hold the tails of a ski in the first vise and the heads of the skis in the second vise. Each vise has its fore movable jaw 15 pushed back so that the hub 40 of each is adjacent the front face of the fore end jaw 13. The tail (say) of the first ('fore') ski is placed bottom-up with its one longitudinal ('fore') edge resting upon platform 21 of the step 20 in the fore end jaw 13. Holding the ski tail relatively planar with the left hand, knob 52 is grasped with the fingers of the right hand and pulled forward so as to bring the platform 37 of the step 36 in movable jaw 15 under the other longitudinal (aft) edge of the ski.

The same operation is repeated with the head of the ski in the second vise, holding the ski in the right hand, grasping the knob of the second vise with the fingers of the left hand, and pulling the knob forward so as to bring the movable jaw 16 of the second vise into contact with its movable jaw 15, which in turn is moved under the aft edge of the fore ski. The fore ski is thus resting bottom-up between the steps of the fore movable jaw 15 and the fore end jaw 13 of each of the two vises on the bench. Next, the second ski is picked up, held in the left hand and placed with the aft longitudinal edge of its tail on the platform 26 of aft end jaw 14; the other end of the same aft edge is placed on the platform of the second vise. Now, holding the ski with the left hand on the platforms of the two aft end jaws, knob 52 is grasped with fingers of the right hand and pushed inwards so that platform 47 of step 46 of movable aft jaw 16 is placed under the fore edge of the second ski, and the side edges of the ski are pressed against the resilient strips 22 secured to the vertical walls of the steps 25 and 46.

An analogous operation is performed on the head of the second ski. Thus, both skis are now placed in the jaws of the vises, each lightly pressed against the resilient strips holding the skis. The locking member is now rotated from the "unlocked" or "open" position to the locked or thread-engaged position. The knobs 52 on each vise are now rotated until the skis are tightly held. This is accomplished because rotation of the knob 52 in the clockwise direction forces movable aft jaw 16 towards aft end jaw 14, and at the same time forces movable fore jaw 15 against the fore end jaw 13, with the skis being held between each pair of jaws. Moreover, particularly if the skis are held between the steps of the jaws, pressure exerted on the skis tends to spread the upper portions of the jaws apart, thus providing a camming effect on the lower portions of the jaws where the guide rails are inserted. This camming effect tends to lock the jaws in position so that the skis are not loosened even if left in the jaws for a considerable period of time.

After the desired tuning of the skis is completed, the arm 64 of the locking member is rotated upwards so as to release engagement of the threads of the arm 61 and place flattened side 63 of the arm 61 next to the threads of rod 50. The skis can now be removed by simply lifting up on them. If desired, the pressure on the skis may first be relieved by backing off the knob 52 one or two turns before releasing the locking member 60.

I claim:

1. A vise having multiple jaws for quickly clamping and releasing a pair of articles such as skis or the like, comprising, (a) first and second fixed upstanding end jaws fixedly disposed in longitudinally spaced apart relationship at a predetermined distance greater than the combined widths of said articles, (b) a pair of parallel guide rails in transversely spaced apart relationship to hold said fixedly disposed jaws apart, (c) first and second movable upstanding jaws slidably disposed on said guide rails, each independently movable with respect to the other, (d) a tube slidably inserted through said first fixed upstanding jaw, said tube being longitudinally reciprocable so as to move said first movable jaw back and forth along said guide rails, (e) a rod, longitudinally translatable within said tube so as to move said second movable jaw back and forth along said guide rails, said rod being at least partially threaded and having one end rotatably disposed in said second movable jaw, and, (f) releasable locking means, to selectively release and lock said movable jaws relative to one another so as to negate free travel of said movable jaws relative to each other except by rotation of said rod.

2. The vise of claim 1 wherein said releasable locking means comprises, (i) a spacing member carried by said tube in front of said first fixed upstanding jaw, and, (ii) a rotatable locking member longitudinally inserted in said spacing member in parallel spaced apart relationship with said rod, said locking member having threads on one side thereof to engage threads on said rod, and, a longitudinally flat surface over a minor portion of its circumference on the other side of said locking member to allow longitudinal translation of said rod without rotation thereof, engagement and disengagement of said threads on said rod being selectively obtained by rotation of said locking member.

3. The vise of claim 2 wherein said first fixed end jaw and said first movable jaw are provided at the top of each, with a stepped portion, each stepped portion facing the other to cooperatingly support a first ski in a normal or inverted horizontal position; and, said second fixed end jaw and said second movable jaw are provided at the top of each, with a stepped portion, each stepped portion facing the other to cooperatingly support, optionally, a second ski in a normal or inverted horizontal position.

4. The vise of claim 3 wherein said first and second fixed end jaws are provided with mounting means for demountably securing them firmly to a horizontal support surface.

5. The vise of claim 4 including elastomeric suction cups removably secured to the base of each said first and second fixed end jaws.

6. The vise of claim 4 including releasably interlockable means of synthetic resinous material secured to the base of each said first and second fixed end jaws, interlockable means being adapted to be removably engaged with similar cooperating interlockable means secured to a mounting means for said vise.

* * * * *